United States Patent [19]

Ishida

[11] 4,285,166

[45] Aug. 25, 1981

[54] DUAL WINDOW ASSEMBLY

[75] Inventor: Kinji Ishida, Toyama, Japan

[73] Assignee: Yoshida Kogyo K. K., Tokyo, Japan

[21] Appl. No.: 67,408

[22] Filed: Aug. 17, 1979

[30] Foreign Application Priority Data

Sep. 4, 1978 [JP] Japan ..... 53-121418[U]
Sep. 6, 1978 [JP] Japan ..... 53-122353[U]

[51] Int. Cl.[3] ..... E06B 7/00
[52] U.S. Cl. ..... 49/63; 49/DIG. 1
[58] Field of Search ..... 49/63, 61, DIG. 1, 64, 49/67, 504, 505, 468; 52/212

[56] References Cited

U.S. PATENT DOCUMENTS

| | | | |
|---|---|---|---|
| 2,136,273 | 11/1938 | Chaffee et al. | 52/212 |
| 2,311,300 | 2/1943 | Dubour et al. | 49/64 |
| 2,703,158 | 3/1955 | Hauck | 49/63 |
| 2,773,571 | 12/1956 | Kelly | 52/212 |
| 2,970,642 | 2/1961 | Parsons | 49/63 X |
| 3,273,287 | 9/1966 | Pease, Jr. | 49/468 |
| 3,436,884 | 4/1969 | Bell et al. | 49/504 X |
| 3,694,961 | 10/1972 | Johnson | 49/505 X |
| 4,048,774 | 9/1977 | Yamamoto | 49/63 |

*Primary Examiner*—Philip C. Kannan
*Attorney, Agent, or Firm*—Hill, Van Santen, Steadman, Chiara & Simpson

[57] ABSTRACT

A dual window assembly comprises an interior window unit adapted to be mounted within an opening in a building wall and an exterior window unit adapted to be mounted on the exterior of the opening. First and second frames of the units have respective first and second mounting flanges which are to be secured together by means of connector strips.

21 Claims, 5 Drawing Figures

DUAL WINDOW ASSEMBLY

BACKGROUND OF THE INVENTION

1. Field of the Invention

This invention relates to a dual window unit, and more particularly a dual window unit construction providing a unit for use in combination with an existing unit disposed in an opening in a building wall.

2. Prior Art

The type of exterior window units with which this invention is concerned provides a high degree of thermal insulation, air-tightness and sound insulation since the units are mounted on the outside of openings in building walls, in which openings other window assemblies have been previously installed.

When installing new exterior window units in combination with existing interior window units, it was required to reconstruct or break down the exterior sidings of the building walls or some of the frame members of the existing interior window units. Considerable difficulty was also experienced in mounting the vertical frames or jambs of the new units in cases where the exterior building walls vary in thickness, and thus the installation work was time-consuming and tedious.

SUMMARY OF THE INVENTION

A dual window assembly for covering an opening in a building wall having an exterior siding, comprises: an interior window unit adapted to be mounted within the opening and on the interior side of the exterior siding, said interior window unit including a first frame and a first pair of sashes mounted within said first frame, said first frame having a first mounting means; an exterior window unit adapted to be mounted on the outside of the building wall, said exterior window unit including a second frame for extending beyond the thickness of the exterior siding, and a second pair of sashes mounted within said second frame, said second frame having a second mounting means; and a connector member connecting said first and second frames together, said connector member including a pair of first and second sections secured to said first and second mounting means, respectively.

It is therefore a primary object of the invention to provide an exterior window assembly having means for facilitating the installation thereof in combination with an existing interior window unit without remodeling or impairing the exterior building walls within which the existing unit is present.

A further object of the present invention is to provide a dual window assembly.

It is another object of the invention to provide an exterior window assembly having means for adjusting the position of an exterior window assembly in alignment with the center axis of the building opening.

Many other advantages, features and additional objects of the present invention will become manifest to those versed in the art upon making reference to the detailed description and the accompanying sheets of drawings in which preferred structural embodiments incorporating the principles of the present invention are shown by way of example.

DETAILED DESCRIPTION OF THE PREFERRED EMBODIMENTS

Figure 1:
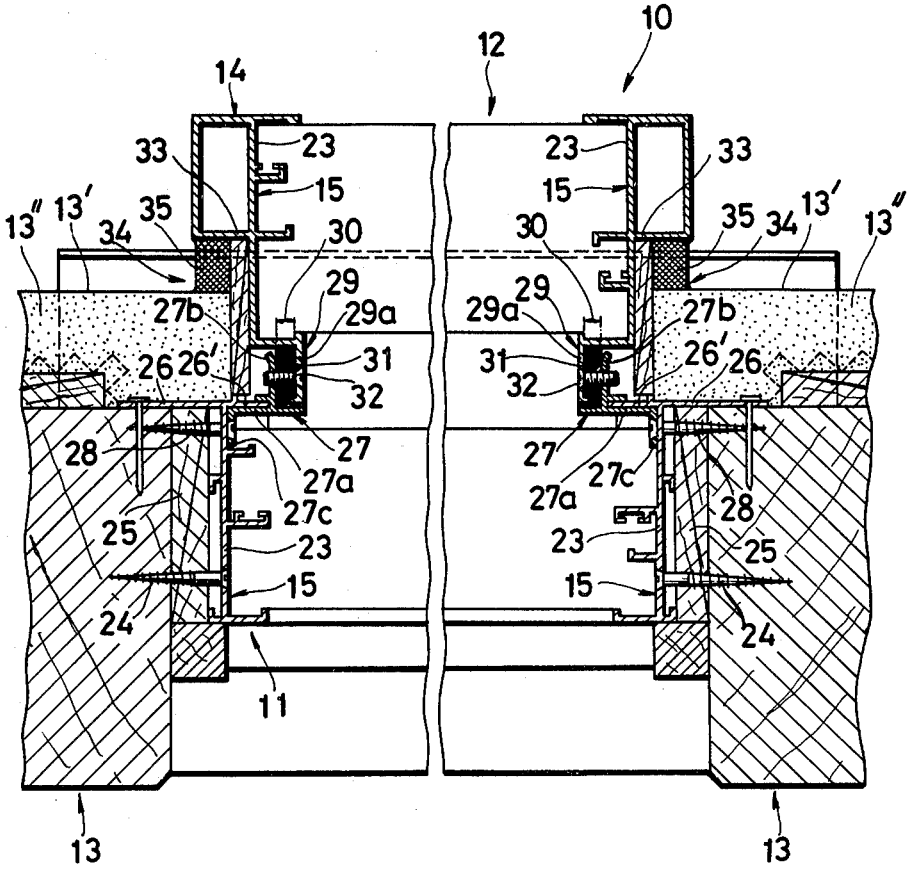
FIG. 1 is a horizontal cross-sectional view through a dual window assembly provided in accordance with the invention.

FIG. 1 shows a dual window assembly 10 comprising an interior window unit 11 mounted within and covering an opening 12 in a building wall 13 and an exterior window unit 14 mounted on the outside of the building wall and interconnected with the interior window unit 11 in a manner hereafter described.

Figure 2:
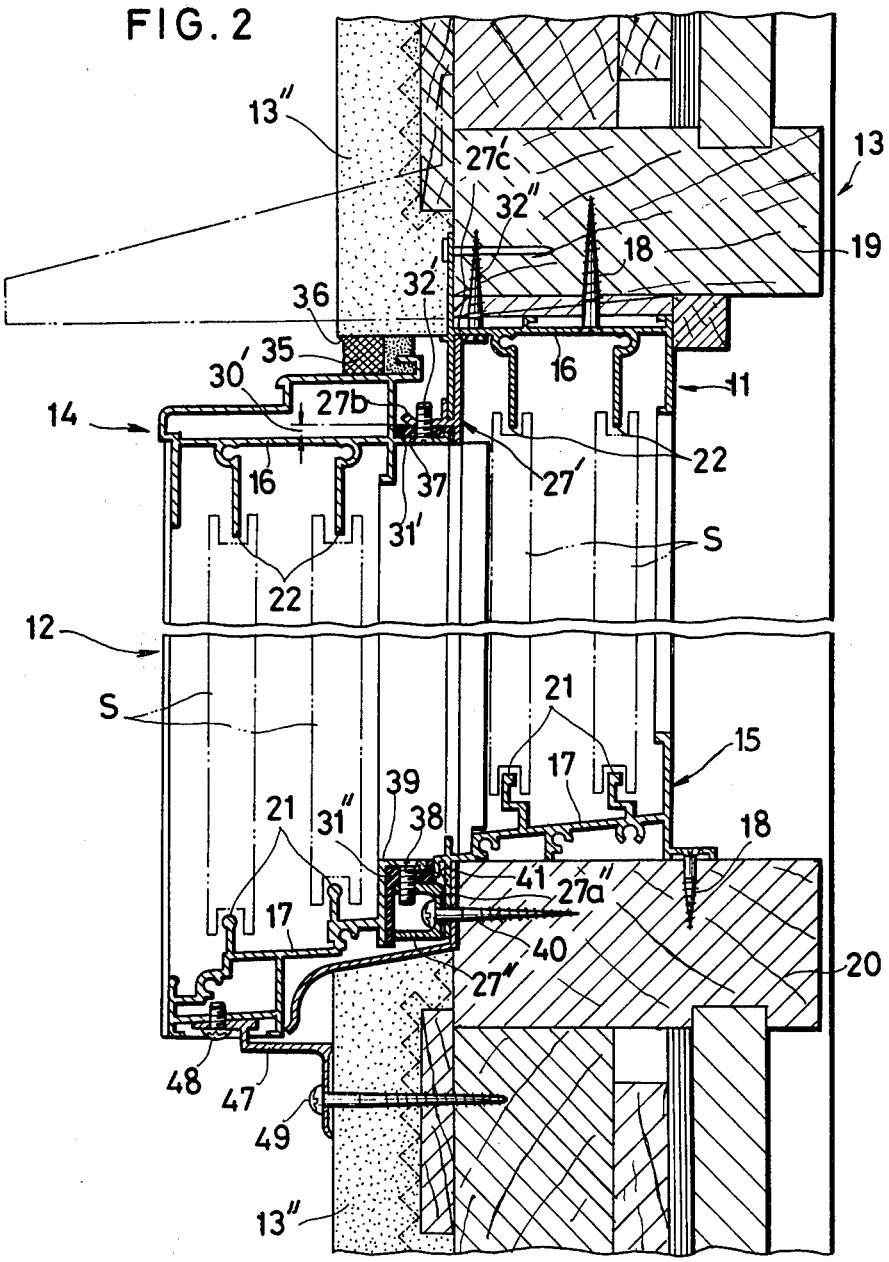
FIG. 2 is a vertical cross-sectional view through the assembly shown in FIG. 1.

For the best advantage of the invention, the interior window unit 11 is considered to have been previously installed or already existing at the time the exterior window unit 14 is installed. The interior window unit 11 broadly comprises, as shown in FIG. 2, a frame 15 made preferably of aluminum extruded into a desired form and including a header 16 and a sill 17 secured by screws 18 or other suitable fastening means to an upper support block 19 and a lower support block 20, respectively, the blocks 19,20 being usually made of wood and embedded in the building wall 13. The frame 15 has a pair of parallel spaced lower flanges or rails 21,21 formed integrally with the sill 17 and a pair of upper flanges or rails 22,22 formed integrally with the header 16, the rails 21,22 being adapted to support thereon a pair of sashes S (FIG. 2) in the usual manner.

The exterior window unit 14, detailed below, may be partially identical in construction to the interior window unit 11 and hence is identified by the same reference numerals for the same or similar parts thereof.

With reference to FIG. 1 the description proceeds dealing with the manner in which the exterior window unit 14 is installed and interconnected with the existing interior window unit 11. A pair of opposed vertical frame member or jambs 23,23 formed integrally with the frame 15 of the interior window unit 11 is screwed as at 24,24 to the framework 25 of the building wall and both have at their respective outer ends horizontally extending integral flanges 26,26 which are substantially "T"-shaped.

A laterally inwardly directed portion 26' of each of the flanges 26,26 is connected to a connector means 27 comprising an elbow **27*a* complementary in shape to and interfitting with the "T"-shaped flange 26 of each jamb 23 and is secured by screws 28 to the framework 25. The connector means 27 has a mounting fin 27*b* extending therefrom toward the exterior of the building wall. The jambs 23,23 of the frame 15 of the exterior window unit 14 have an "L"-shaped flange 29 from which an inwardly directed portion 29*a* extends in parallel with the mounting fin 27*b* and defines therewith an opening or space 30 for receiving a sealing strip or gasket 31, made preferably of polyvinyl chloride. A screw(s) 32 passes through the "L"-shaped flange 29, through the gasket 31 and through the mounting fin 27*b*, and thus secures these parts together, establishing a connection between the interior and exterior window units 11 and 14. The screw 28** extends through a vertical (as viewed in FIG. 1) portion 27*c* and the jamb 23 of the interior window unit 11 into the framework 25 of the building wall 13.

The jambs 23,23 of the exterior window unit 14 have an outwardly disposed horizontal (as viewed in FIG. 1) portion 33 extending in parallel with the outside surface 13′ of the exterior siding 13″ of the building wall 13 and defining therewith a clearance 34 which may vary with the thickness of the siding 13″ of the building wall. The clearance 34 is filled with a suitable material 35 such as a caulking compound. The clearance 34 which communicates all around the outer periphery of the frame 15 is likewise filled up with the caulking compound 35 as between the lower surface 36 (FIG. 2) of the upper portion of the siding 13″ and the header 16 of the exterior window unit 14.

A connector means 27′, similar to the previously described connector means 27, adapted to interconnect the interior window unit 11 with the exterior window unit 14, has a mounting fin 27′*b* integral with the connector means 27′ lying horizontally in parallel with an inwardly extending flange portion 37 of the header 16 and defines therewith an opening or space 30′ for receiving a sealing strip or gasket 31′. A screw(s) 32′ passes through the flange portion 37, gasket 31′ and mounting fin 27′*b* and thus secures these parts together. Another screw 32″ extends through a horizontal portion 27′*c* of the connector means 27′ and the header 16 of the interior window unit 11 into the upper support block 19.

A somewhat different connector means 27″ is provided for interconnecting the sill 17 of the exterior window unit 14 with that of the interior window unit 11, the means 27″ being secured by a screw(s) 38 through a sealing strip 31″ to an inverted "L"-shape flange 39 of the sill 17. Another screw 40 extends horizontally through a vertical portion 27″*a* of the connector means 27″ and a downwardly directed flange portion 41 of the sill 17 of the interior window unit 11 into the lower support block 20. Thus a connection is established between the interior and exterior window units 11,14 at their respective headers 16 and sills 17. A double-L shaped support 47 is secured at opposite ends to the sill 17 of the exterior window unit 14 and the building wall 13 by a pair of screws 48,49, respectively.

Figure 3:
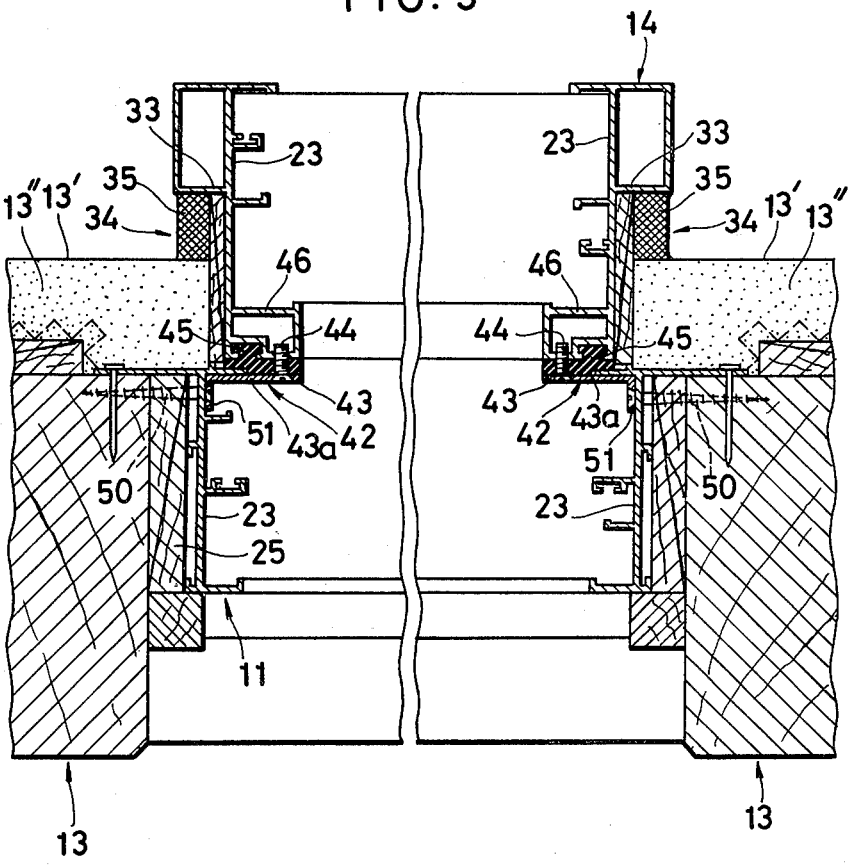
FIGS. 3 and 4 are views similar to FIG. 1 but showing modified assemblies.

A modification 42 of the connector means 27 is shown in FIG. 3 which interconnects the interior and exterior window units 11 and 14 through their respective jambs 23,23. The modified connector means 42 is in the form of a substantially "L"-shaped elbow 43 having a horizontal (as viewed in FIG. 3) portion 43*a* secured by a screw 44 through a sealing strip or gasket 45 to a rectangular hollow flange 46 of each of the paired jambs 23,23 of the exterior window unit 14, the arrangement being such that the screw 44 is concealed from external view. Another screw 50 extends through a vertical (as viewed in FIG. 3) portion 51 of the "L"-shaped elbow 43 and the jamb 23 of the interior window unit 11 into the framework 25 of the building wall 13.

Figure 4:
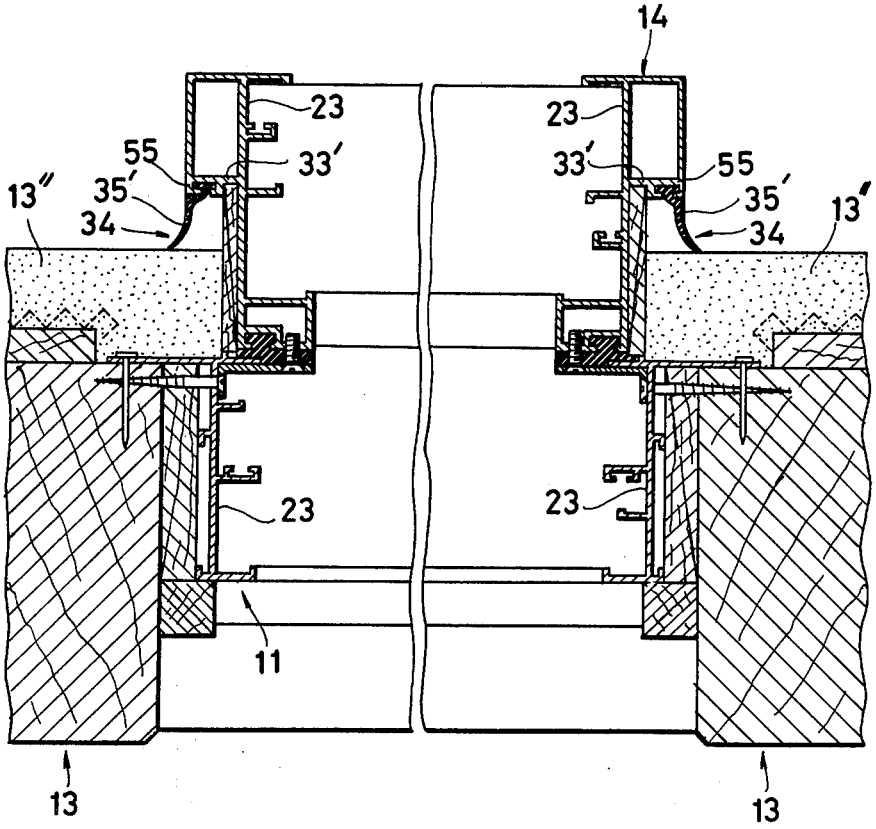
Figure 5:
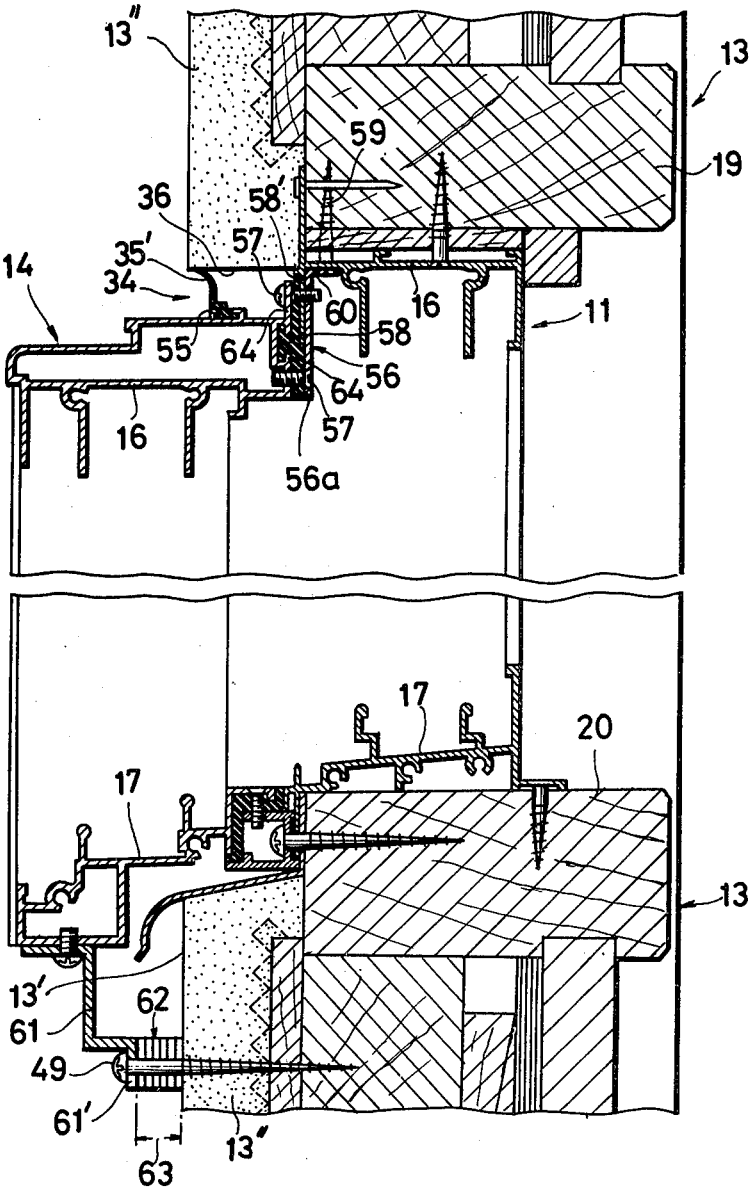
FIG. 5 is a vertical cross-sectional view through the assembly shown in FIG. 4.

According to a modified form of the invention shown in FIGS. 4 and 5, an outwardly projecting horizontal (as viewed in FIG. 4) portion 33′ of the jamb 23 of the exterior window unit 14 has means 55 for carrying a joint 35′ which is adapted to suitably cover the clearance 34 which may vary with the thickness of the siding 13″ of the building wall 13. The joint 35′ comprises a flexible and resilient sealing strip made preferably of a synthetic resin such as polyvinyl chloride. The clearance 34 which communicates all around the outer pheriphery of the frame 15 of the exterior window unit 14 is likewise covered up with the sealing strip 35′ as between the lower surface 36 (FIG. 5) of the upper portion of the siding 13″ and the header 16 of the exterior window unit 14. Further, the interior and exterior window units 11 and 14 are interconnected through their respective headers 16,16 by a further modified connector means 56 (FIG. 5). The modified connector means 56, like that of FIG. 2, is in the form of a substantially "L"-shaped elbow having a vertical portion 56*a* secured by a pair of screws 57,57 through a sealing strip or gasket 58 to vertical portions 64 of the header 16 of the exterior window unit 14. One of the pair of screws 57 passes through an inwardly directed flange 58 of the header 16 of the interior window unit 11. Another screw 59 extends through a horizontal portion 60 of the connector means 56 and the header 16 of the interior window unit 11 into the upper support block 19. Furthermore, a double-L shaped support member 61 is secured at its lower portion 61′ by the screw 49 to the building wall 13 through a spacer means 62. The spacer means 62 comprises a plurality of plates and the number of these plates may be selected depending on the size of a clearance 63 between the lower portion 61′ of the support member 61 and the outside surface 13′ of the exterior siding 13″ of the building wall 13, the clearance 63 varying with the thickness of the siding 13″.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A dual window assembly for covering an opening in in a building wall having an exterior siding, said dual window assembly comprising, in combination:

(a) an interior window unit including a first rectangular frame supporting a first pair of sashes, said frame being adapted to be disposed in the wall opening and having means by which it may, by a first set of fasteners, be secured to and supported by the wall, and further having a first mounting flange composed of vertical portions integral with the four sides of said first frame;

(b) an exterior window unit including a second rectangular frame supporting a second pair of sashes, said second frame being adapted to project into the wall opening from the exterior while extending outwardly beyond the siding, the inner portion of such inward projection comprising a second mounting flange composed of port integral with the four sides of said second frame, and disposed adjacent to but spaced from said first mounting flange; and (c) a connector having a first section held against said first mounting flange by said first set of fasteners, and a second section secured to said second mounting flange by a second set of fasteners, whereby said exterior window unit is supported by said interior window unit.

2. A dual window assembly according to claim 1, said first mounting flange comprising an exterior marginal portion of each jamb of said first frame for supporting said exterior window unit.

3. A dual window assembly according to claim 1, said first mounting flange comprising an exterior marginal portion of a header of said first frame for supporting said exterior window unit.

4. A dual window assembly according to claim 1, said first mounting flange comprising an exterior marginal portion of a sill of said frame for supporting said exterior window unit.

5. A dual window assembly according to claim 1, including a separate support member supporting a sill of said second frame, said support member having a first horizontal section secured by a third set of fasteners to said sill of said second frame, and a second vertical section adapted to be secured to the outside of the exterior siding of the building wall by a fourth set of fasteners.

6. A dual window assembly according to claim 1, said first set of fasteners comprising a plurality of screws threadedly extending through said first section and said first mounting flange and adapted to extend into the framework of the building wall, and said second set of fasteners comprising a plurality of screws.

7. A dual window assembly according to claim 1, in which said connector is in the form of an elbow complementary to said first mounting flange.

8. A dual window assembly according to claim 1, in which said second mounting flange comprises a flange extending along an interior side edge of a header of said second frame, said last-named flange having a portion extending parallel to said second section of said connector.

9. A dual window assembly according to claim 1, in which said second mounting flange comprises a flange extending along an interior side edge of a sill of said second frame, said last-named flange having a portion extending parallel to said second section of said connector.

10. A dual window assembly according to claim 1, in which said second mounting flange comprises a flange extending along an interior side edge of each jamb of said second frame, said last-named flange having a portion extending parallel to said second section of said connector.

11. A dual window assembly according to claim 10, in which said last-named flange on said second frame has a hollow and substantially rectangular cross-section.

12. A dual window assembly according to claim 10, in which said last-named flange on said second frame has a substantially L-shaped cross-section.

13. A dual window unit assembly according to claim 1, including a first seal means interposed between said second mounting flange on said second frame and said second section of said connector through which seal means said second set of fasteners extends.

14. A dual window assembly according to claim 13, said first seal means comprising a sealing strip made of polyvinyl chloride engaging said second set of fasteners.

15. A dual window assembly according to claim 1, in which a header of said second frame is adapted to be disposed beneath and to be spaced by a clearance from a downwardly facing edge surface of the exterior siding, and a seal means adapted to be interposed above said header of said second frame and below the downwardly facing edge surface of the exterior siding for sealing said clearance.

16. A dual window assembly according to claim 15, said seal means comprising a sealing strip made of polyvinyl chloride, said sealing strip being anchored on said header of said second frame.

17. A dual window assembly according to claim 1, including a flange projecting outwardly from an exterior marginal portion of each jamb of said second frame, said last-named flange being adapted to overhang as a trim and to be spaced by a first clearance from an exterior surface of the exterior siding.

18. A dual window assembly according to claim 17, further including a seal means adapted to be interposed between said last-named flange and the exterior surface of the exterior siding for sealing said first clearance.

19. A dual window assembly according to claim 18, said seal means comprising a sealing strip made of polyvinyl chloride, said sealing strip being anchored on said last-named flange of said second frame.

20. An exterior window unit for covering a building wall opening on the exterior side of a building wall having an exterior siding, there being mounted within the opening an interior window unit on the interior side of the exterior siding, the interior window unit including a first frame secured by a first set of fasteners to the framework of the building wall and having a first mounting flange, said exterior window unit comprising, in combination:

(a) a second frame for extending beyond the thickness of the exterior siding of the building wall, said second frame having a second mounting flange;

(b) a pair of sashes mounted within said second frame in parallel closely spaced planes; and (c) a connector for interconnecting said second frame with the first frame of the interior window unit, said connector comprising a pair of first and second sections and a second set of fasteners, said first section being adapted to be secured by said first set of fasteners to the first mounting flange on the first frame and said second section being securable by said second set of fasteners to said second mounting flange on said second frame.

21. An exterior window unit according to claim 20, said first set of fasteners comprising a plurality of screws threadedly extendable through said first section and said first mounting flange and adapted to extend into the framework of the building wall, and said second set of fasteners comprising a plurality of screws.

* * * * *